US010102945B2

(12) United States Patent
Miyakawa et al.

(10) Patent No.: US 10,102,945 B2
(45) Date of Patent: Oct. 16, 2018

(54) COATING DEVICE AND METHOD OF COATING

(71) Applicant: Yazaki Corporation, Tokyo (JP)

(72) Inventors: Daisuke Miyakawa, Susono (JP); Yasunobu Matsumoto, Tokyo (JP); Takaji Shimada, Saitama (JP)

(73) Assignee: Yazaki Corporation, Tokyo (JP)

( * ) Notice: Subject to any disclaimer, the term of this patent is extended or adjusted under 35 U.S.C. 154(b) by 62 days.

(21) Appl. No.: 15/170,032

(22) Filed: Jun. 1, 2016

(65) Prior Publication Data

US 2016/0358692 A1 Dec. 8, 2016

(30) Foreign Application Priority Data

Jun. 8, 2015 (JP) ..... 2015-115698

(51) Int. Cl.
*B05B 5/08* (2006.01)
*B05B 5/00* (2006.01)
(Continued)

(52) U.S. Cl.
CPC ..... *H01B 7/2806* (2013.01); *B05B 5/082* (2013.01); *B05B 5/087* (2013.01); *B05B 13/02* (2013.01);
(Continued)

(58) Field of Classification Search
CPC ..... B05B 5/14; B05B 5/05; H01B 7/28
See application file for complete search history.

(56) References Cited

U.S. PATENT DOCUMENTS

2003/0029379 A1* 2/2003 Onogawa ..... B05B 5/0255 118/621
2005/0008771 A1* 1/2005 Goto ..... H01B 7/292 118/420
(Continued)

FOREIGN PATENT DOCUMENTS

JP 48-057550 U1 11/1971
JP 2007-226999 A 9/2007
(Continued)

OTHER PUBLICATIONS

Office Action dated Apr. 11, 2017, issued for the corresponding Japanese patent application No. 2015-115698 and English translation thereof.

*Primary Examiner* — Binu Thomas
(74) *Attorney, Agent, or Firm* — Locke Lord LLP

(57) ABSTRACT

Provided is a coating device and a method capable of coating a conductor of a plurality of electrical wires with coating material with simple configuration and of coating without exposing the conductor. A nozzle and a coating area of a terminal-equipped electrical wire are applied to voltage by a voltage applying unit such as to be electrified with polarity different from each other, and jetting jet liquid forms jet liquid over the whole coating area, forms the coating layer with anticorrosion material on a surface of the terminal-equipped electrical wire, and coats the coating area including a conductor with anticorrosion material without being exposed. Furthermore, it is possible to allow the nozzle jet the jet liquid and to move the nozzle in an arranging direction of the terminal-equipped electrical wire, and also to coat the coating area of the terminal-equipped electrical wire with anticorrosion material.

17 Claims, 3 Drawing Sheets

(51) Int. Cl.

| | |
|---|---|
| ***B05C 5/00*** | (2006.01) |
| ***H01B 7/285*** | (2006.01) |
| ***H01B 7/28*** | (2006.01) |
| ***H01B 13/16*** | (2006.01) |
| ***H01B 1/02*** | (2006.01) |
| ***B05B 13/02*** | (2006.01) |
| ***B05C 5/02*** | (2006.01) |

(52) U.S. Cl.
CPC ..... *B05C 5/0212* (2013.01); *H01B 1/02* (2013.01); *H01B 13/165* (2013.01)

(56) References Cited

U.S. PATENT DOCUMENTS

2010/0077792 A1* 4/2010 Gurin ..... F16C 33/10
239/690
2015/0287496 A1* 10/2015 Sato ..... H01B 7/00
29/867

FOREIGN PATENT DOCUMENTS

JP 2007226999 A * 9/2007
JP 2010-055901 A 3/2010
JP 2011-113708 A 6/2011

* cited by examiner

COATING DEVICE AND METHOD OF COATING

CROSS REFERENCE

The present application claims priority to Japanese Patent Application No. 2015-115698 filed Jun. 8, 2015, which is hereby incorporated by reference in its entirety.

TECHNICAL FIELD

The present invention is related to a coating device and a method for coating a conductor of an exposed electrical wire with coating material.

BACKGROUND ART

Conventionally, there has been proposed a method of coating an exposed conductor of aluminum electrical wire with anticorrosion material (coating material) (PTL 1 for example). It is contrived in the PTL 1 that spraying such air upon painting anticorrosion composed of liquid silicone robber prevents anticorrosion material from flowing into a connection part of a mating terminal at a terminal fitting attached to the conductor.

CITATION LIST

Patent Literature

[PTL 1]
Japanese Patent Publication No. 2011-113708

SUMMARY OF INVENTION

Technical Problem

Disadvantageously, the invention according to PTL 1 exhibits disadvantage such that upon adhering liquid to an aluminum surface, a large surface tension is liable to be generated, and a liquid anticorrosion material is flown from the aluminum surface, resulting in possible occurrence of coating remnant of the anticorrosion material due to spraying such air as well. Such problems can also be posed in an electrical wire where conductor is composed of other metal not only aluminum electrical wire. Furthermore, coating anticorrosion material over a plurality of aluminum electrical wires requires a dispenser (jetting outlet) corresponding to each aluminum electrical wire, which leads to complication of the device.

An object of the present invention is to provide a coating device and coating method for coating with a simple configuration a conductor of a plurality of electrical wires with coating material and for enabling to coat so as not to expose the conductor.

Solution to Problem

In order to solve the abovementioned problems, the invention according to a first aspect is a coating device for coating an exposed conductor of an electrical wire with coating material, the coating device including: a holder for arranging and holding a plurality of electrical wires; a jetting unit including a jetting outlet made of metal arranged spaced apart from the holder, and jet liquid including the coating material out of the jetting outlet; a voltage application unit for applying a voltage to the jetting outlet and the conductor and electrifying the jetting outlet and the conductor; a moving unit for relatively-moving the jetting outlet and the holder along an arrangement direction of the plurality of electrical wires; a controller controlling the jetting outlet and moving unit, the controller, while letting the jetting outlet to jet the liquid, allowing the moving unit to relatively-move the jetting outlet and the holder along the arranging direction.

The electrical wire of the present invention is preferably an aluminum electrical wire.

The voltage applying unit of the present invention preferably applies voltage such that the jetting outlet and the conductor are each electrified to have polarity different from each other.

The moving unit of the present invention preferably allows the moving unit to relatively-moves the jetting outlet and the holder along a longitudinal direction of the electrical wire.

The coating material of the present invention is preferably anticorrosion material.

The invention according to a second aspect is a method for coating an exposed conductor of an electrical wire with coating material, the method including: arranging a plurality of electrical wires; applying a jetting outlet arranged spaced apart from the electrical wire and the conductor and electrifying the jetting outlet and the conductor; while jetting the liquid including the coating material out of the jetting outlet, relatively-moving the jetting outlet and the plurality of electrical wires along an arrangements direction of the plurality of electrical wires.

Advantageous Effects of Invention

According to the present invention recited in the first and the second aspects, applying voltage to and electrifying the jetting outlet and the conductor of the electrical wire makes the liquid jetted from the jetting outlet electrified and drawn near the conductor. As such, electrical drawing of the liquid near the conductor enables the liquid unlikely to be repelled by surface tension, and suppresses the coating material from being flown from the surface of the conductor, allowing for coating the conductor with the coating material so as not to expose the conductor. Furthermore, while letting liquid jet from the jetting outlet, relatively-moving the jetting outlet and the holder (the plurality of electrical wires) along the arranging direction of the electrical wire allows with the simple configuration the conductor of the plurality of electrical wires to be coated. At this time since the electrified liquid is liable to diffuse and is drawn to the conductor, it is possible to coat the conductor with coating material so as not to expose the conductor when jetting the liquid without controlling relatively-moving in a direction other than the jetting outlet and the holder in accordance with such shape of the conductor.

According to the present invention, since the electrical wire is the aluminum electrical wire, it is possible to save weight. Furthermore, even though the surface tension becomes large due to composition of the conductor by aluminum or aluminum alloy, it is possible to coat with coating material such as not to expose the conductor as mentioned above.

According to the present invention, applying voltage such that the jetting outlet and the conductor each have polarity different from each other makes the electrified liquid jetted from the jetting outlet more readily drawn by the conductor electrified with different polarity. Furthermore, while the whole conductor becomes generally the same potential, the liquid adhered to the conductor is electrified to be the same polarity as the conductor but the whole layer of the liquid does not become the same potential due to its relatively high resistance, and the absolute value of the potential of the liquid surface relative to the ground potential becomes smaller than that relative to the ground potential of the conductor surface. Therefore, the liquid newly jetted is liable to be drawn near a portion to which the liquid is not adhered in the conductor, enabling the liquid to adhere to the whole surface of the conductor.

According to the present invention, relatively-moving the jetting outlet and the holder along the longitudinal direction of the electrical wire makes it possible to coat the whole of the conductor and the terminal fitting by while jetting the liquid and relatively-moving the jetting outlet and the holder along the arranging direction, then relatively-moving the jetting outlet and the holder in the longitudinal direction and while jetting the liquid again and relatively-moving the jetting outlet and the holder along the arranging direction when the exposed conductor is long or when such terminal fitting is attached to the conductor and the terminal fitting is also coated with coating material.

According to the present invention, coating the conductor with anticorrosion material can suppress corrosion. Note that the anticorrosion material is preferably aqueous urethane resin coating, which can be readily treated by dissolving and diffusing the urethane resin coating into water so as to become jet liquid as liquid including anticorrosion material.

DESCRIPTION OF EMBODIMENT

Figure 1:
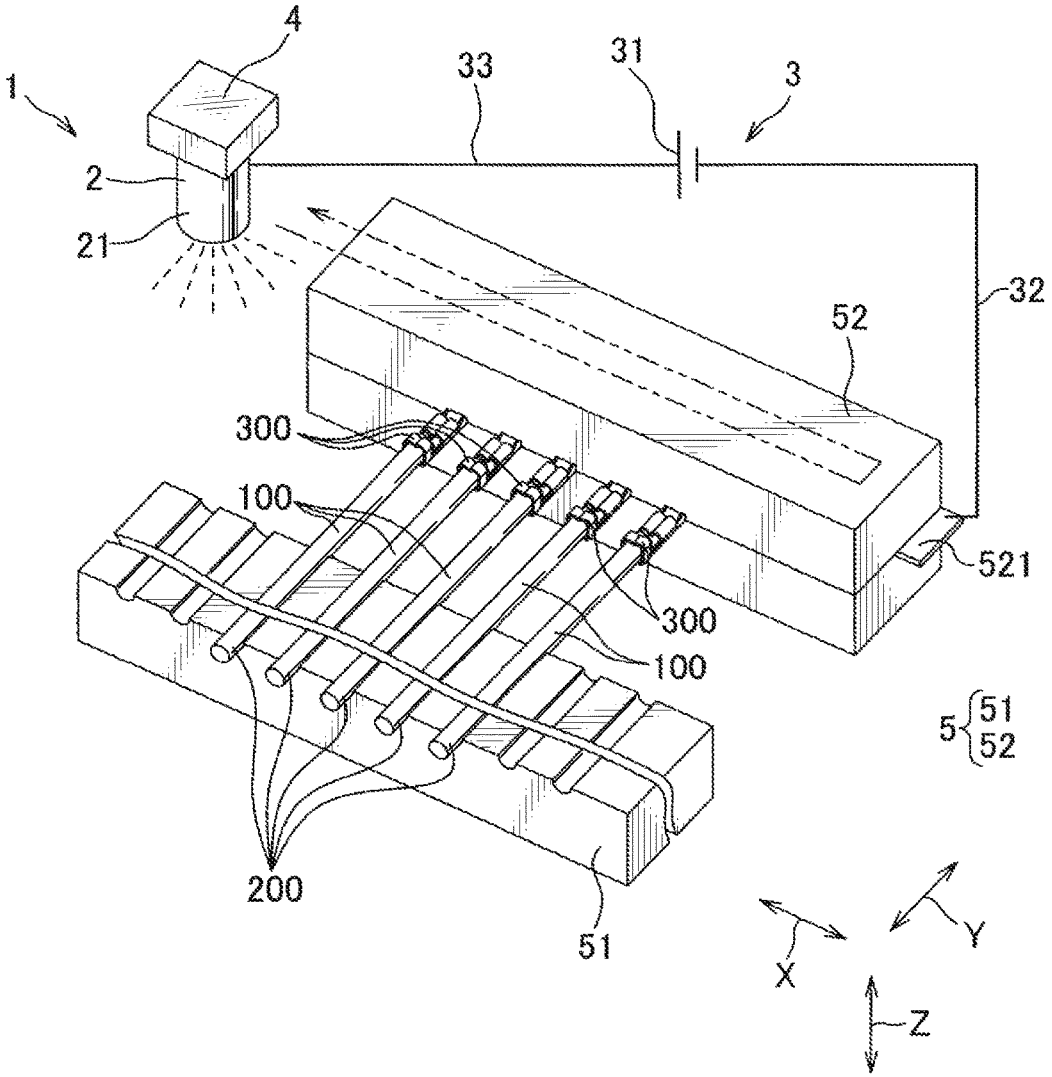
FIG. 1 is a perspective view illustrating a whole configuration of a coating device according to an embodiment of the present invention.

Hereafter, embodiments of the present invention will be described with reference to figures. A coating device 1 of the present embodiment is, as illustrated in FIG. 1, a device for coating a coating area A, to be mentioned later, of a plurality of terminal-equipped electrical wires 100 with anticorrosion material as coating material, a spray gun 2 as a jetting unit for jetting jet liquid as liquid including anticorrosion material, voltage applying unit 3 for applying a voltage to a nozzle 21 of the spray gun 2, and a electrode 521 to be mentioned later, a moving unit 4 for moving the nozzle 21, a holder 5 for arranging and holding the plurality of electrical wires 100, and a not-shown controller for controlling the whole device. Note that, in the present embodiment, as shown in FIG. 1, a arranging direction of the plurality of terminal-equipped electrical wires denotes an X direction, a longitudinal direction of the terminal equipped-electrical wire 100 a Y direction, a direction intersecting with the X direction and the Y direction a Z direction.

Figure 2A:
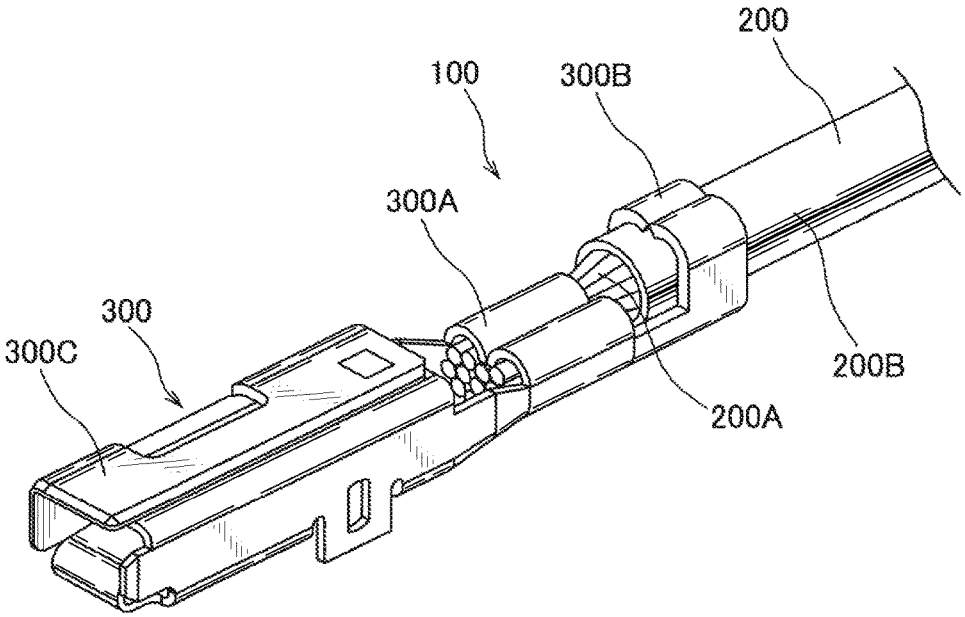
FIGS. 2A and 2B are perspective views illustrating a terminal equipped-electrical wire to be coated with coating material with the coating device.
Figure 2B:
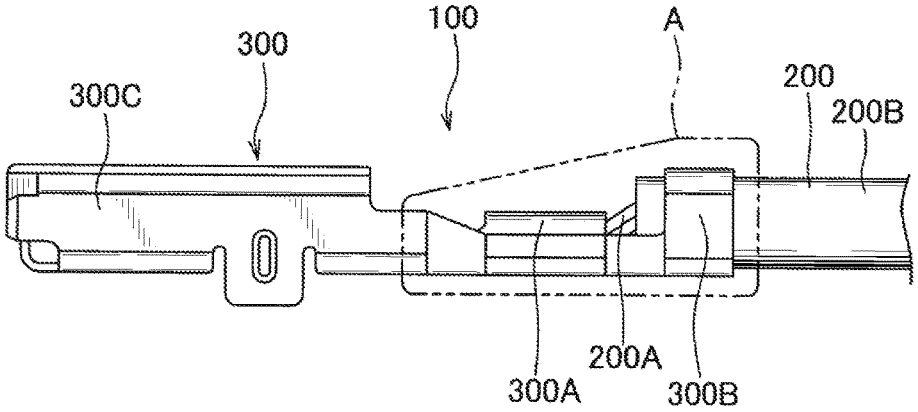

The terminal equipped-electrical wire 100 is, as shown in FIGS. 2A, 2B provided with an aluminum electrical wire 200 as an electrical wire, and a terminal fitting 300 connected to an end of the aluminum electrical wire 200. The aluminum electrical wire 200 includes a conductor 200A made of aluminum or aluminum alloy, and an insulating coating 200B coating an outside of the conductor 200A. The terminal fitting 300 is made of adequate metal such as copper, us constituted by a first swaging portion 300A to be swaged to a portion exposed from the insulating coating 200B in the conductor 200A, a second swaging portion 300B to be swaged to the insulating coating 200B, and a electrical connection portion 300C to be electrically connected to a mating terminal, and is electrically connected to the conductor 200A. Of exposed metal portions of the terminal equipped-electrical wire 100 a portion except the electric connection portion 300C is coated with anticorrosion material as a coating area A (that is, the exposed conductor 200A, the first swaging portion 300, and the second swaging portion 300B).

The anticorrosion material is aqueous urethane resin for example, which becomes jet liquid by dissolving or diffusing in water. Namely, drying of the jet liquid consequently leaves anticorrosion material on the metal surface, so as to coat metal with anticorrosion material.

The spray gun 2 includes a nozzle 21 as a jetting outlet for jetting the jet liquid, a not-shown housing for accommodating the jet liquid, a not-shown elastic connection portion to connect the nozzle 21 and the housing, and a not-shown pressing portion for letting the nozzle 21 jet the jet liquid by exerting pressure, and jets the jet liquid in Z direction (namely, a direction intersecting with a plane including the arranging direction and the longitudinal direction of the terminal equipped-electrical wire 100) shown in FIG. 1 as a jetting direction. The spray gun 2 sprays the jet liquid by containing air. The nozzle 21 is made of conductive metal such as iron or aluminum.

The voltage applying unit 3 includes a direct current power source 31, a first connection portion 32, a second connection portion 33 to be electrically connected to the nozzle 21. The direct current power source 31 is assumed to apply voltage such as 20 kV between the first connection portion 32 and the second connection portion 33. In the present embodiment, the first connection portion 32 is connected to a negative electrode of the direct current power source 31, the second connection portion 33 a positive electrode of the direct current power source 31, namely, the voltage applying unit 3 applies voltage such that the electrode 521 is electrified to have negative charge, the nozzle 21 is electrified to have positive charge. Note that using independent two direct current power source, the first connection portion may be connected to one of direct current power source, the second connection portion the other of direct current power source, and thereby a potential difference between the ground potential and the first connection portion potential and a potential difference between the ground potential and the second connection potential may be different from each other.

The moving unit 4 includes three linear moving motors advancing and retreating in the X direction, the Y direction, and the Z direction, respectively, and configured to allow the nozzle 21 to paralley move in the X, Y, and Z directions, and allows the nozzle 21 to three-dimensionally move while jetting direction is kept in the Z direction.

The holder 5 includes an electrical wire placing portion 51 having a groove where the aluminum electrical wire 200 of the plurality of terminal-equipped electrical wires 100 is placed, and a terminal holder 52 nipping and holding the electrical connection portion 300C of the plurality of terminal fittings 300 in the Z direction. The terminal holder 52 covers the electrical connection portion 300C so as to suppress adherence of the anticorrosion material, and adheres to and holds the terminal fitting 300 so as not to induce gap in the aluminum electrical wire 200 side, so as to prevent the jet liquid from flowing into the electrical connection portion 300C side from the aluminum electrical wire 200C. Furthermore, the terminal holder 52 includes an electrode 521 to contact with, and be electrically connected to, each tip of the electrical connection portion 300C of the plurality of terminal fittings 300. The electrode 521 is positively electrified, the conductor 200A and the terminal fitting 300 are thereby positively electrified as well, and the terminal-equipped electrical wire 100 is positively electrified in the coating area A. The terminal holder 52 rotates, as holding the terminal fitting 300, by 180 degrees about the Y direction as a shaft direction, being configured to invert the whole thereof.

Thereafter, a method will be described of jetting the jet liquid toward the terminal-equipped electrical wire 100 using the coating device 1, and coating the terminal-equipped electrical wire 100 with anticorrosion material.

Firstly, an operator lets the holder 5 hold the plurality of terminal-equipped electrical wires 100, and activates the coating device 1. The controller controls the moving unit to align the nozzle 21. Namely, a position of the nozzle 21 in the Y direction is adjusted to the first swaging portion 300A of the terminal fitting 300, a position in the X direction is adjusted to the terminal-equipped electrical wire 100 arranged at the one side (left side in FIG. 1), and an interval from the terminal-equipped electrical wire 100 in the Z direction is adjusted. Then the controller lets the direct current power source 31 start applying voltage before letting the spray gun 2 start jetting the jet liquid, and moves the nozzle 21 toward the other side in the X direction (right in FIG. 1) as shown by two dot chain line in FIG. 1. Namely, the nozzle 21, while jetting the jet liquid, moves in X direction. Note that when a quality of the jet liquid upon a start of jetting may be unstable, the jet liquid may preliminarily be jetted where the jet liquid does not reach the terminal-equipped electrical wire 100.

When the nozzle 21 moves at a position opposite to the other side of the terminal fitting-electrical wire 100 in the X direction, the controller once stop jetting the jet liquid, and moves the nozzle 21 along the Y direction before restart jetting and moves the nozzle 21 toward the one side in the X direction. Note that the number of times of moving the nozzle 21 in the X direction may adequately be set according to a thickness of the coating of the anticorrosion material or the quantity of jetting of the jet liquid or the like. Furthermore, the nozzle 21 may be moved in the Y direction according to a breadth of the coating area of the terminal-equipped electrical wire 100, but if the coating area A is narrow, the nozzle 21 may not be moved in the Y direction.

After the nozzle 21 finishes moving and jetting, the operator once stops the coating device 1, and reverses the terminal holder 52. Then the operator restarts the coating device 1, and, as similar to the step before reversing the terminal holder 52, while moving the nozzle 21, lets the jet liquid jet. Note that the jet liquid is routed into the opposite side of the nozzle 21 in the terminal-equipped electrical wire 100, but the terminal holder 52 may also not be reversed if the coating thickness of the anticorrosion material can well be secured in the opposite side. Furthermore, the number of times of moving of the nozzle 21 in the X direction may be different before and after the reversing of the terminal holder 52.

When jetting the jet liquid is completed, the operator stops the coating device 1, and dries the jet liquid adhering to the terminal-equipped electrical wire 100. At this time the jet liquid may be dried by heating using such a heater, or be naturally dried. When the jet liquid dries out, the coating layer by anticorrosion material is formed on the surface of the terminal-equipped electrical wire 100.

Figure 3A:
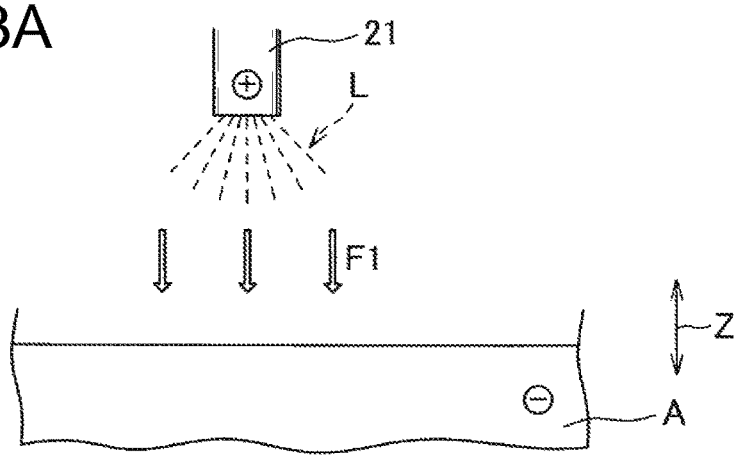
FIGS. 3A, 3B and 3C are cross-sectional views schematically illustrating a way how jet liquid is adhered to a metal surface of the terminal equipped-electrical wire.

Herein, an electrical interaction between the jet liquid and the metal surface in the coating area A of the terminal-equipped electrical wire 100 will be described. Firstly, the jet liquid is also positively electrified because the nozzle 21 is positively electrified. Therefore, as shown in FIG. 3A, the jet liquid L is drawn to the negatively-electrified coating area A by Coulomb force F1.

Figure 3B:
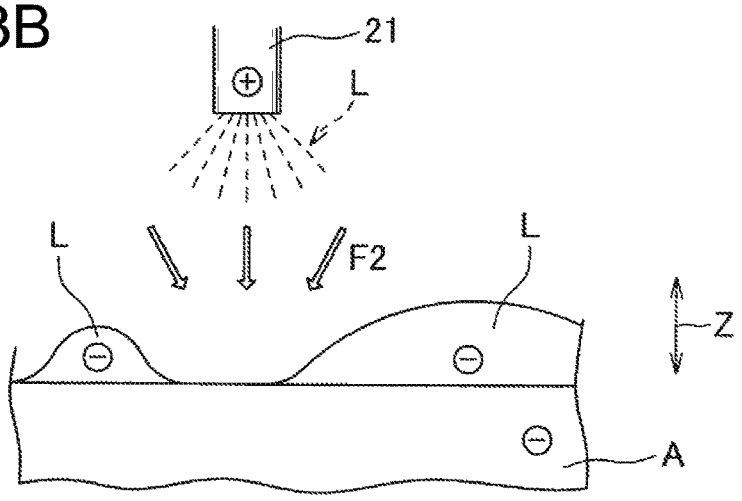

As shown in FIG. 3B, when the jet liquid L adheres to the metal surface, the positive charge held by the jet liquid L moves to the metal side, and the adhering jet liquid L is also negatively electrified because the metal surface is negatively electrified. At this time the whole metal generally becomes the same potential, whereas because the jet liquid L has relatively high resistance, the whole layer of the metal surface does not become the same potential, a magnitude of an electric potential V1 of the surface of the adhering jet liquid near at the nozzle 21 side becomes smaller than that of an electric potential V2 of a portion of the whole surface to which the jet liquid L does not adhere.

Figure 3C:
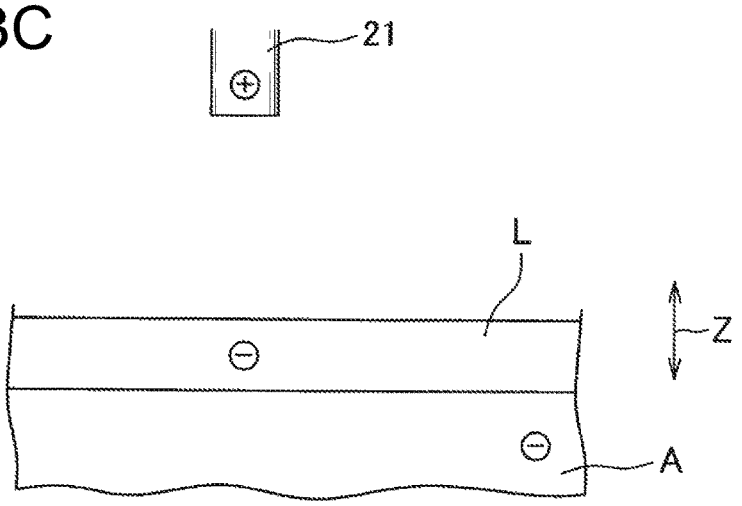

Therefore, as shown in FIG. 3B, when the jet liquid L, with adhering to a part of the metal surface, further continues to jet, and is liable to be drawn to the exposed metal surface. Namely, Coulomb force F2 is exerted facing the exposed metal surface. As such the jet liquid L continues to jet, the jet liquid L, as shown in FIG. 3C, adheres to the whole metal surface so as to form a layer of the jet liquid L.

According to such present embodiment, there lie the following effects. Namely, the voltage is applied such that the nozzle 21 and the coating area A of the terminal-equipped electrical wire 100 are electrified differently from the other by the voltage applying unit 3, and the jet liquid is jetted, which forms a layer of the jet liquid over the whole coating area A, and which forms coating layer by the anticorrosion material on the surface of the terminal-equipped electrical wire 100. Therefore, the coating area A including the conductor 200A can be coated with anticorrosion material without being exposed.

Furthermore, allowing the nozzle 21 to jet the jet liquid and to move the nozzle 21 along the X direction that is parallel to an arrangement direction of the terminal-equipped electrical wire 100 enables the coating area A of the plurality of terminal-equipped electrical wires to be coated with the simple configuration with anticorrosion material. At this time, the electrified jet liquid is liable to diffuse and is drawn to the coating area A, it is possible to coat the coating area A with the anticorrosion material so as not to be exposed without controlling to move the nozzle 21 in the Y direction or Z direction in accordance with such a shape of the coating area A upon jetting the jet liquid.

Furthermore, covering the electrical connection portion C with the terminal holder 52 suppresses the jet liquid having been drawn toward the terminal fitting 300 from adhering to the electrical connection portion 300, possibly keeping well conductivity of the electrical connection portion 300.

Furthermore, coating the coating area A of the terminal-equipped electrical wire 100 with the anticorrosion material as coating material can suppress the coating area A from corrosion. Furthermore, the anticorrosion material has waterproof property, suppressing water from entering into surfaces of the conductor 200A and the terminal fitting 300 in the coating area A.

Note that the present invention is not limited to the aforementioned embodiments, but includes other configurations to achieve the object of the present invention, also includes such variations as mentioned below.

For example in the aforementioned embodiments, the voltage applying unit 3 is made such that the electrodes 521 is electrified with a negative charge and the nozzle 21 is applied with voltage so as to be electrified with positive charge, but the voltage applying unit 3 may apply voltage so that the electrode 521 is electrified with positive charge and the nozzle 21 with negative charge. Furthermore, the voltage applying unit 3 may apply voltage so that the electrode 521 and the nozzle 21 are electrified with the same polarity, or the one may be electrified with ground potential, the electrified jet liquid in these configurations moves by electric field formed between the nozzle 21 and the coating area A so as to be drawn to the coating area A.

Furthermore, in the aforementioned embodiments, the moving unit 4 moves the nozzle 21, but provision of a moving unit to move the holder 5 may relatively-move the nozzle 21 and the terminal-equipped electrical wire 100. Furthermore, the moving unit may move the nozzle 21 or the holder 5 at least in the X direction, but not in the Y direction and the Z direction.

Furthermore, in the aforementioned embodiments, the anticorrosion material is illustrated as coating material by example, but material may be what is for forming an insulating layer on a metal exposed portion, coating material for suppressing damage of the metal face, or any suitable material coating at least the conductor 200A. Furthermore, the jet liquid may be dissolved or diffused in the suitable liquid, or what is composed of liquid coating material and is cured by being exposed and heated by ultraviolent ray or X ray.

Furthermore, in the aforementioned embodiments, though the anticorrosion material is coated as a target of the terminal-equipped electrical wire 100 having aluminum material wire in which the conductor 200A is composed of aluminum or aluminum alloy, the material of the conductor of the electrical wire is not limited to aluminum, such as suitable metal of copper or alloy in which suitable metals are combined for example.

Although other configurations or methods for implementing the present invention are disclosed above, the present invention is not limited thereto. Namely, the present invention was mainly especially illustrated and described with respect to particular embodiments, but it is possible to variously modify by a person skilled in the art what is described above, in shape, material, quantity and other detailed configuration without departing from spirit and object of the present invention. Therefore, because limitation of shape, material or the like disclosed above is exemplarily described for the present invention being readily understood, but not for limiting the present invention, the description of names of material excluding a part or the whole of limitation of shape, material or the like should be included in the present invention.

REFERENCE SIGNS LIST

1 coating device
2 spray gun (jetting unit)
3 voltage applying unit
4 moving unit
5 holder
21 nozzle (jetting outlet)
200 aluminum electrical wire (electrical wire)
200A conductor
L jet liquid (liquid)

The invention claimed is:

1. A coating device for coating an exposed conductor of an electrical wire and a swaging portion of a terminal fitting electrically connecting to the conductor with coating material, the coating device comprising:

a holder configured to arrange and hold a plurality of electrical wires;

a jetting unit including a jetting outlet made of metal arranged spaced apart from the holder, and the jetting unit jetting liquid including the coating material out of the jetting outlet;

a voltage application unit configured to apply a voltage to the jetting outlet and the conductor, and electrify the jetting outlet and the conductor; and a moving unit configured to relatively-move the jetting outlet and the holder along an arrangement direction of the plurality of electrical wires, wherein while the jetting outlet jets the liquid, the moving unit is controlled to relatively-move the jetting outlet and the holder along the arrangement direction, wherein the holder includes a terminal holder covering a side located facing the jetting unit of an electric connection portion of the terminal fitting to be electrically connected to a mating terminal, the terminal holder includes an electrode to contact with and be electrically connected to a tip of the electric connection portion when the holder holds the electrical wires, and wherein the voltage application unit is electrically connected to the electrode.

2. The coating device according to claim 1, wherein the plurality of electrical wires are aluminum.

3. The coating device according to claim 1, wherein the voltage application unit applies voltage such that the jetting outlet and the conductor are each electrified to have polarity different from each other.

4. The coating device according to claim 2, wherein the voltage application unit applies voltage such that the jetting outlet and the conductor are each electrified to have polarity different from each other.

5. The coating device according to claim 1, wherein the moving unit relatively-moves the jetting outlet and the holder along a longitudinal direction of the plurality of electrical wires.

6. The coating device according to claim 2, wherein the moving unit relatively-moves the jetting outlet and the holder along a longitudinal direction of the plurality of electrical wires.

7. The coating device according to claim 3, wherein the moving unit relatively-moves the jetting outlet and the holder along a longitudinal direction of the plurality of electrical wires.

8. The coating device according to claim 4, wherein the moving unit relatively-moves the jetting outlet and the holder along a longitudinal direction of the plurality of electrical wires.

9. The coating device according to claim 1, wherein the coating material is anticorrosion material.

10. The coating device according to claim 2, wherein the coating material is anticorrosion material.

11. The coating device according to claim 3, wherein the coating material is anticorrosion material.

12. The coating device according to claim 4, wherein the coating material is anticorrosion material.

13. The coating device according to claim 5, wherein the coating material is anticorrosion material.

14. The coating device according to claim 6, wherein the coating material is anticorrosion material.

15. The coating device according to claim 7, wherein the coating material is anticorrosion material.

16. The coating device according to claim 8, wherein the coating material is anticorrosion material.

17. A method for coating an exposed conductor of an electrical wire with coating material, the method comprising:

providing a coating device comprising:

a holder configured to arrange and hold a plurality of electrical wires;

a jetting unit including a jetting outlet made of metal arranged spaced apart from the holder, and the jetting unit jetting liquid including the coating material out of the jetting outlet;

a voltage application unit configured to apply a voltage to the jetting outlet and the conductor, and electrify the jetting outlet and the conductor; and a moving unit configured to relatively-move the jetting outlet and the holder along an arrangement direction of the plurality of electrical wires, wherein while the jetting outlet jets the liquid, the moving unit is controlled to relatively-move the jetting outlet and the holder along the arrangement direction, wherein the holder includes a terminal holder covering a side located facing the jetting unit of an electric connection portion of the terminal fitting to be electrically connected to a mating terminal, the terminal holder includes an electrode to contact with and be electrically connected to a tip of the electric connection portion when the holder holds the electrical wires, and wherein the voltage application unit is electrically connected to the electrode, arranging and holding the plurality of electrical wires by the holder;

applying the voltage to the jetting outlet arranged spaced apart from the electrical wire and the conductor, and electrifying the jetting outlet and the conductor, by the voltage application unit, via the electrode of the holder;

while jetting the liquid including the coating material out of the jetting outlet, relatively-moving the jetting outlet and the plurality of electrical wires along the arrangement direction of the plurality of electrical wires, by the moving unit.

* * * * *